United States Patent [19]

Howe et al.

[11] 4,262,274

[45] Apr. 14, 1981

[54] THERMAL ELECTRIC SWITCH

[75] Inventors: Bernard L. Howe, Williamsville; Robert C. Pringle, Lockport, both of N.Y.

[73] Assignee: General Motors Corporation, Detroit, Mich.

[21] Appl. No.: 29,890

[22] Filed: Apr. 13, 1979

[51] Int. Cl.[3] ..... H01H 37/38

[52] U.S. Cl. ..... 337/320; 337/396; 73/368.3

[58] Field of Search ..... 337/320, 317, 309, 306, 337/318, 382, 383; 73/368.3; 337/396, 117

[56] References Cited

U.S. PATENT DOCUMENTS

| | | | |
|---|---|---|---|
| 2,694,415 | 11/1954 | Dillon | 73/368.3 |
| 3,435,682 | 4/1969 | Linke et al. | 73/368.3 |

*Primary Examiner*—Harold Broome

*Attorney, Agent, or Firm*—R. L. Phillips

[57] ABSTRACT

A thermal electric switch having a thermally expansible material operating on an elastomeric diaphragm to operate a switch wherein the switch is an electrically conductible spring element and is operated by a force transmitting arrangement from the diaphragm to effect switching operation with or without snap action.

5 Claims, 6 Drawing Figures

THERMAL ELECTRIC SWITCH

This invention relates to a thermal electric switch and more particularly to a thermal electric switch having a power element with a thermally expansible material acting on an elastomeric diaphragm to effect switch operation.

In systems where it is desired to accurately control a thermally responsive make and break electrical function where there is a relatively high electrical current delivery, it is common practice to use a bi-metal element to effect switching. However, such a switch normally exhibits a hysteresis to reset temperature differential which is substantially larger than that desired in some applications.

For example, in vehicle cooling systems having an electric motor powered fan for forcing air through the radiator, it is desirable that the fan be operated only when the thermostat is wide-open, and the radiator, absent such forced air circulation, is then no longer capable of meeting the engine's cooling requirements. To illustrate, in a typical vehicle cooling system, the thermostat may be calibrated to be wide open at 220° F. and, therefore, it is desired that the fan be switched on only when the coolant temperature exceeds this level, by some required amount, such as when the vehicle is at rest. The fan should then switch off when the coolant temperature drops below this value with the vehicle moving to minimize the fan's electrical power usage and, therefore, fuel consumption. A bi-metal switch exhibits a minimum reset temperature differential of about 10°–20° F. in use and if set to switch on at 230° F. coolant temperature, it may not then switch off until the coolant temperature is about 210° F. which is substantially below that desired for optimum engine performance. Thus, not only is there wasted fuel consumption but the engine performance is also affected with a substantial delay in the coolant temperature again reaching the desired level. Furthermore, the switch's reset temperature differential may then overlap with the operating temperature range of the thermostat's such that the fan could remain on indefinitely with its fuel consumption requirement since the thermostat would not independently then know when to open wider, to decrease coolant temperature, but would instead be dependent upon the reset differential characteristics as relating to fan operation. On the other hand, if the switch-on temperature is raised to prevent such overlap with the thermostat, the fan operation is substantially delayed in meeting the engine's cooling requirements.

It is known that the use of a thermally expansible material and elastomeric diaphragm to operate a switch could diminish the temperature reset differential or hysteresis exhibited by a bi-metal switch. However, the known combinations thereof typically require a complex diaphragm design and/or switch elements and have limited versatility.

These problems are solved while other advantages are gained by the present invention with a thermal electric switch having a power element with a thermally expansible material acting on an elastomeric diaphragm and then through a force transmitting arrangement to operate a switch mechanism with or without snap action, dependent upon the range of reset temperature differential desired, which in either case may be made substantially smaller than that available with known bi-metal switches. The force transmitting arrangement permits the diaphragm to have an easy to manufacture shape of uniform thickness which is easy to assemble and the switch's electrical elements are also easy to manufacture and assemble. The switch includes a housing to which the power element is joined with a diaphragm therebetween and in which a stationary electric contact element, an electrical grounding element, and an electrically conductible switch spring element are mounted. For use in a vehicle coolant system, the switch spring element is inherently held out of contact with the stationary contact element and is flexible to contact therewith to electrically connect same with the grounding element to close the fan's motor circuit. However, it will be understood that for other applications, these conditions can be reversed. The force transmitting arrangement is also mounted in the switch housing and for this particular switch application operates to transmit force from the diaphragm to hold the switch spring element against the grounding element and also flex the switch spring element from its switch-off to switch-on condition as the expansible material expands while reaching the desired switch-on temperature which becomes the calibration temperature of the switch. The force transmitting arrangement includes a convex surface that is engaged by and permits the diaphragm to stretch thereabout to allow for expansion of the thermally expansible material on temperature excursions past the switch-on temperature. In one embodiment, the force transmitting arrangement includes a ball engaging the diaphragm and a compression coil spring between the ball and the switch spring element to effect snap action of the latter and a resulting low reset temperature differential such as about 10° F. or less. Furthermore, the coil spring is yieldable in the switch-on condition to accommodate the highest anticipated over-temperature condition without bottoming-out and thereby over-forcing the switch spring element against the stationary contact during such an extreme temperature excursion. In another embodiment, the force transmitting arrangement comprises a rigid member which effects flexing of the switch spring element to its switch-on condition without snap action so that an even lower reset temperature differential of less than 5° F. is obtained. This is obtained while still accommodating substantial temperature excursions of the thermally expansible material past the switch-on temperature by allowing stretching of the diaphragm about a convex surface which is formed on the end of this rigid member where it engages the diaphragm.

These and other objects and advantages of the present invention will be more apparent from the following description and drawing in which.

Figure 1:
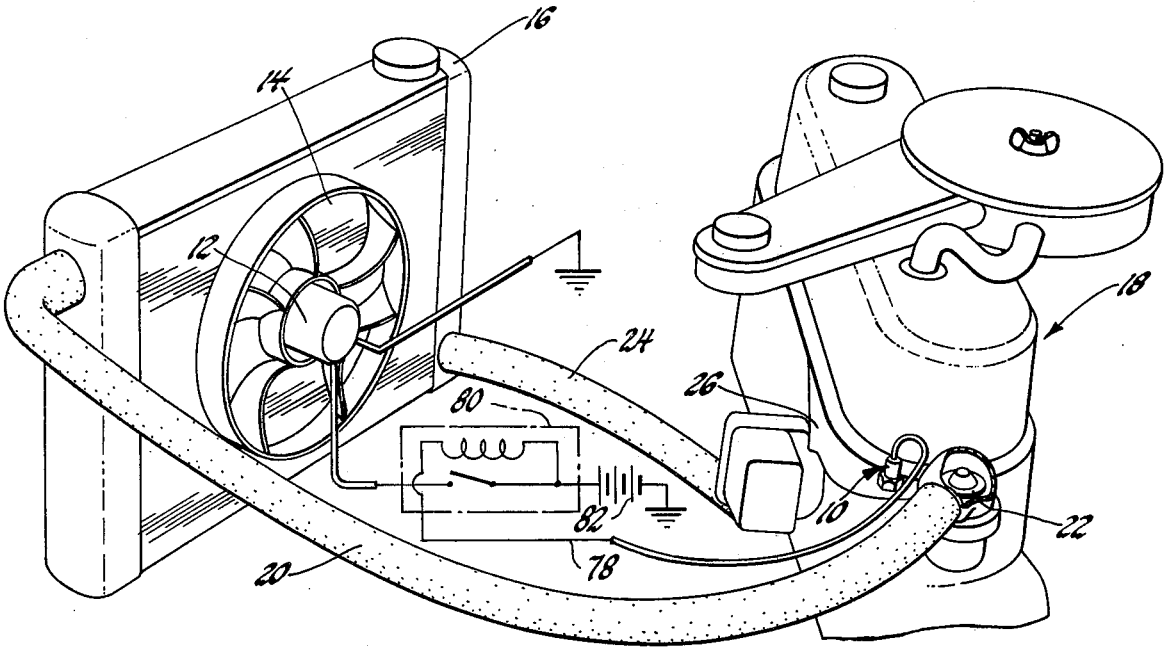
FIG. 1 is a pictorial view of a vehicle engine cooling system having an electrically powered fan operated by a switch according to the present invention.

Referring to FIG. 1, there is shown a switch 10, according to the present invention, in use in a vehicle engine coolant system for controlling a motor 12 that drives a fan 14 to pull air through a radiator 16 for the vehicle's engine 18. Coolant which is being circulated through the engine by a pump, not shown, is either by-passed back through the engine or directed to the radiator through a hose 20 under the control of a thermostat 22. After being cooled by the radiator the coolant is returned to the engine by another hose 24. The thermostat 22 is mounted on the engine 18 in the coolant outlet and is of a conventional type which may be calibrated to be wide open when the coolant temperature at the outlet of the engine reaches a certain desired temperature such as 220° F. Should the coolant temperature thereafter tend to increase, it is desired that the fan be switched on to provide increased cooling at the radiator but then on coolant temperature decrease below this temperature, it is desired that the fan be switched off so as to eliminate its electrical power usage and thereby minimize fuel consumption. Furthermore, the switch's reset temperature should not fall too far below or overlap with the thermostat's wide open temperature setting. Otherwise, the thermostat could then start throttling down and thereby tend to raise coolant temperature forcing the fan switch to remain on when the added cooling effect provided by the fan is not actually needed. For example, the fan operation may only be needed to meet the engine's cooling requirements when the vehicle is stopped but because of fan switch—thermostat temperature overlap may be caused to remain on when the vehicle is stopped and also when the vehicle is moving and forcing sufficient air through the radiator.

Figure 2:
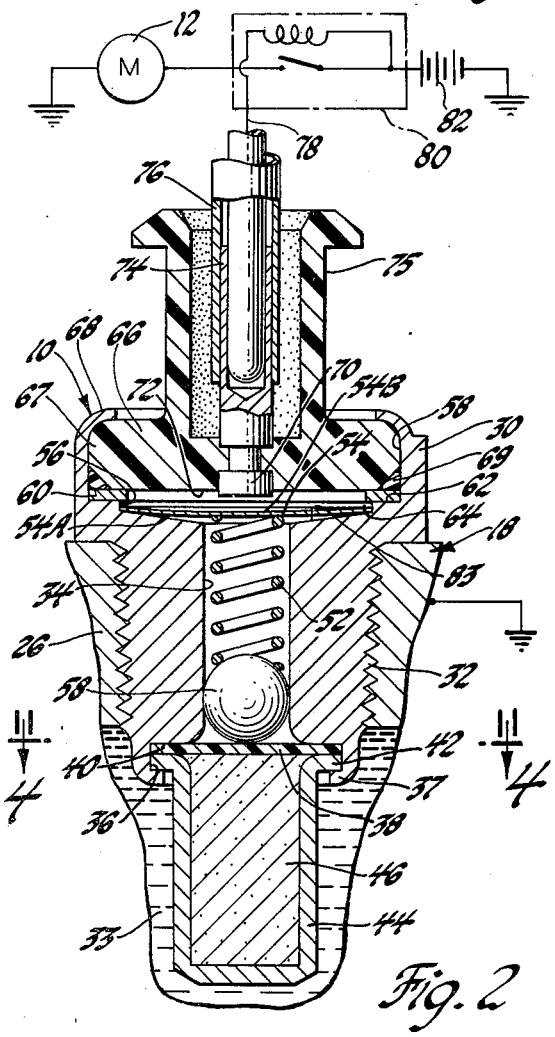
FIG. 2 is an enlarged cross-sectional view of one embodiment of the switch with the switch shown in its open condition.
Figure 3:
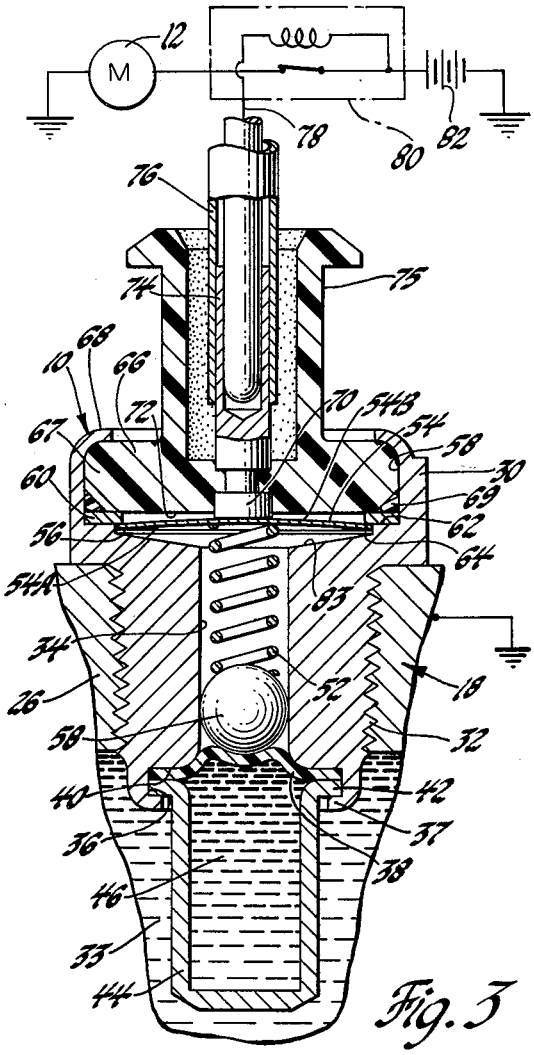
FIG. 3 is a view similar to FIG. 2 but with the switch shown in its closed condition.
Figure 4:
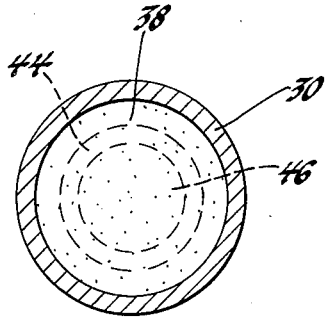
FIG. 4 is a view taken along the line 4—4 in FIG. 2.

Given this set of conditions, there is shown in FIGS. 2 and 3, one embodiment of the switch 10 which is capable of switching the fan on with a reset temperature differential or hysteresis not exceeding about 10° F. and can thus be calibrated so as to turn the fan on at 230° F. or only 10° F. above the thermostat's wide open temperature setting and then switch the fan off at 220° F. before the coolant temperature decreases into the thermostat's throttling, temperature range. Referring to FIGS. 1 and 2, the switch 10 is adapted to be mounted directly on the engine 18 and comprises a hex fitting 30 made of electrically conductible material. The fitting 30 has a male pipe thread 32 which engages a threaded opening in the engine that is open to the engine coolant 33 close to where the coolant reaches the thermostat 22. The fitting 30 has a central bore 34 extending therethrough which joins with a counterbore 36 in the end 37 of the fitting exposed to the coolant. As shown in FIGS. 2 and 4, a normally flat, circular diaphragm 38 of uniform thickness and made of elastic material seats at one side adjacent its periphery with the radial shoulder 40 of the counterbore 36 and on its other side is engaged opposite this shoulder by a radially outwardly extending flange 42 of a rigid cup 44 which is located in the path of the coolant. The cup 44 is closed by the diaphragm 38 and is filled with a thermally expansible material 46 such as wax. The cup 44 is permanently joined to the fitting 30 by clinching the annular end 37 of the latter over the cup flange. This clinching forces the cup flange 42 tightly against the diaphragm 38 and the diaphragm in turn, tightly against the shoulder 40 so that the wax is thus sealed in the cup to form a power element for operating the switch while the coolant is sealed from the fitting's bore 34.

A ball 58 is slidably closely fitted in the bore 34 and engages on opposite sides with the center of diaphragm 38 and one end of a compression coil spring 52 which is also mounted in the bore 34 but with substantial side clearance with respect thereto. The opposite end of coil spring 52 engages one side 54A of a circular, electrically conductible switch spring element 54 which is made of a resilient material such as spring steel. The switch spring element 54 is disk-shaped and is mounted in the fitting 30 in an accommodating counterbore 56 joining with the bore 34 at the end thereof opposite that joining with the diaphragm accommodating counterbore 36. The fitting 30 has another counterbore 58 of larger diameter joining with counterbore 56 and a ring-shaped electrically conductible grounding element 60 is loosely fitted in the larger counterbore 58 and against the radial shoulder 62 which joins these counterbores. The inner radius of the grounding element 60 extends radially inwardly of the periphery of the switch spring element 54 and has a small side-to-side interference or axial clearance 64 therewith whereby the switch spring element is trapped in the fitting. A molded cap 66 of non-conductive material has a shoulder 67 closely fitted in the counterbore 58 and the exterior annular end 68 of the fitting is clinched over the outer corner of the cap shoulder 67 to permanently join the cap to the fitting and also compress an elastomeric ring 69 against the counterbore 58 and grounding element 60 to thereby seal off the interior of the fitting at this end and also hold the grounding element tightly in place. An electrical contact element 70 is fixed to the cap 66 by being molded in place therewith and extends from the cap's inner face 72 so as to be opposite to and engageable with a center portion of side 54B of the switch spring element 54 as shown in FIG. 2. The contact element 70 is formed with an integral male terminal 74 which extends into a central collar 75 formed on the cap 66 and receives a plug 76 that is connected by an insulated wire 78 to a relay 80 in the fan motor circuit which is powered by the vehicle's battery 82.

In the switch's normally open condition as shown in FIG. 2, the expansible material 46 is in a contracted condition and there is no preload on the coil spring 52 so that the diaphragm 38 remains relatively flat and the switch spring element 54 inherently retains its preassembly condition with its peripheral edge loosely held between the grounding element 60 and the tapered shoulder 83 which joins the fitting's bore 34 and counterbore 56. In this state, the side 54A of the switch spring element 54 engaged by the coil spring 52 is convex while its other side 54B is concave and spaced a substantial distance at its center from the stationary contact 70 to thereby effect an open condition in the fan motor circuit. Then on the expansible material 46 experiencing a temperature rise, in this case an increase in coolant temperature, it expands and while doing so the force transmitting means provided by the ball 58 and coil spring 52 transmit a force from the diaphragm 38 to positively hold the side 54B of the switch spring element 54 adjacent the peripheral edge thereof against the grounding element 60 to assure grounding thereof. In addition, the force transmitting means also acts on the center of the switch spring element 54 to urge its side 54B toward engagement with the stationary contact 70. The switch is calibrated so that at the desired switch-on temperature, which in this case is 230° F., the force transmitted is sufficient to snap the switch spring element 54 into engagement with the stationary contact 70 as shown in FIG. 3 with its side 54B then having a convex surface while its other side 54A which is engaged by the coil spring 52 then has a concave surface. The stationary contact element 70 is then connected to ground at the engine block 26 through the switch spring element 54, grounding element 60 and hex fitting 30 with the holding of the switch spring element against the grounding element assuring positive grounding to thus close the fan motor circuit to turn and hold the fan motor on. The expansible material 46 may expand further because of the coolant temperature continuing to rise though the fan is on but such temperature excursions are prevented from harming the switch because the convex surface of the ball 58 permits the diaphragm to stretch thereabout within the bore 34 and also because the coil spring 52 by predetermination, remains contractible, i.e. will not bottom out, at the highest anticipated temperature excursion.

With the switch in its on or closed condition as shown in FIG. 3 and as the temperature starts dropping below the switch-on temperature, the expansible material 46 contracts to decrease the force of the diaphragm 38 on the ball 58 and coil spring 52 and thus on the switch spring element 54 until eventually the switch spring element 54 is permitted to return and be reset in its open condition breaking the electrical connection as shown in FIG. 2. Thus, the switch has the ability to control and in particular lower the reset temperature differential by choice of the expansion rate of the expansible material 46, the spring rate of compression spring 52 and/or the spring force of the switch spring element 54.

For example, the reset temperature differential may be decreased by selection of expansible materials having progressively higher expansion rates and with the materials commercially available, the switch embodiment in FIGS. 2 and 3 is easily capable of operating with a reset temperature differential of 10° F. or even less. On the other hand, the compression spring 52 may have a higher spring rate requiring less expansion from the expansible material used and thus less temperature change to obtain the force required to snap the switch spring element to its closed condition. Conversely, a lower spring rate will require more temperature change to reduce the spring force acting on the switch spring element sufficiently to allow reset and breaking of the electrical contact. Then as to the switch spring element 54 itself, it may be selected so as to require a lower snap force and thus less temperature change than a spring switch element which requires a higher snap force because less compression of the compression spring 52 is required to switch on. With the above ability to control the reset temperature and for the radiator fan motor application shown, the FIGS. 2–3 embodiment may thus be readily calibrated to switch the fan on at 230° F. and reset at 220° F. to switch the fan off without overlapping with the thermostat's operation and without substantially delaying operation of the fan when required. However, it will be understood that these set and reset temperatures are only illustrative of what the switch is capable of doing in one particularly demanding commercial application.

Figure 5:
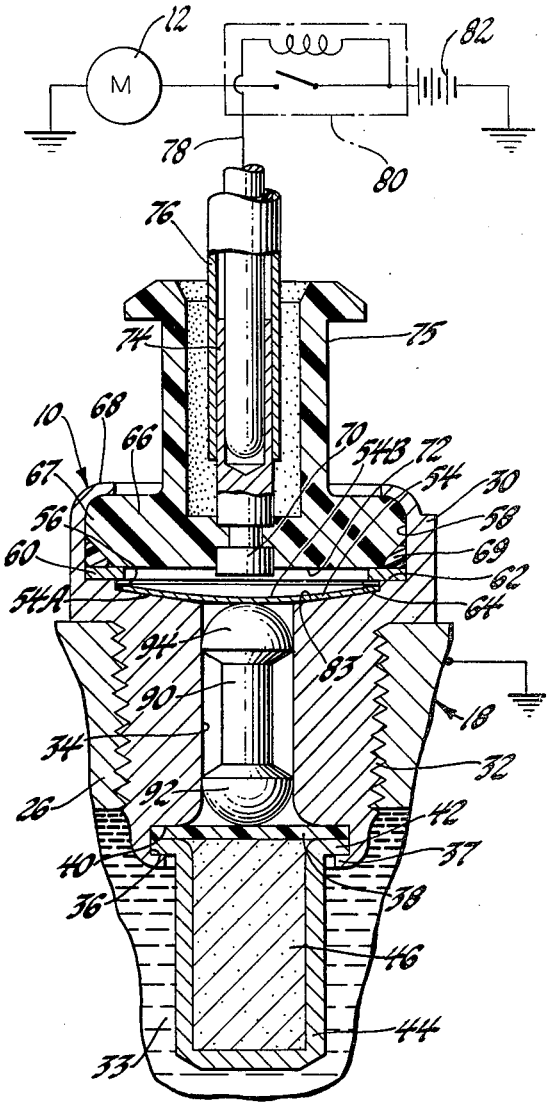
FIG. 5 is an enlarged cross-sectional view of another embodiment of the switch with the switch shown in its open condition.
Figure 6:
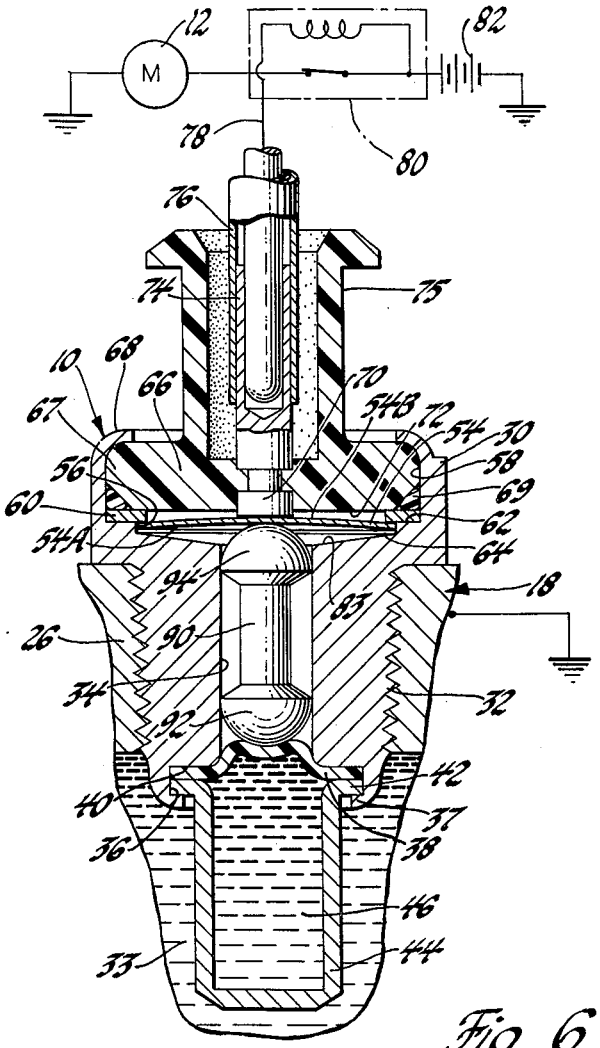
FIG. 6 is a view similar to FIG. 5 but with the switch shown in its closed condition.

The embodiment of the switch shown in FIGS. 5 and 6 has the ability to control reset differential to an even lower value, e.g. a reset temperature differential less than 5° F. This is accomplished with a simple change in the force transmitting means as shown in FIGS. 5 and 6 wherein parts corresponding to those shown in the FIGS. 2, 3 and 4 embodiment are identified by the same numbers and the substituting structure identified by new numbers. Referring to FIGS. 5 and 6, the force transmitting means is simply a rigid member 90 which is slidably fitted in the bore 34 in the fitting 30 between the diaphragm 38 and switch spring element 54. The member 90 has a dumbbell shape with a rounded head 92 at one end which engages the center of the diaphragm 38 and a rounded head 94 at the opposite end which engages the center of the switch spring element 54. In this embodiment and with the switch in its open or off condition as shown in FIG. 5, there is again no preload on the force transmitting means, in this case the rigid member 90, and the switch spring element 54 is conditioned like in the FIGS. 2, 3 and 4 embodiment. Then when the expansible material 46 expands, the rigid member 90 is forced by the diaphragm 38 to act directly on the switch spring element 54 to hold same against the grounding element 60 while forcing it toward engagement with the stationary contact element 70. However, in this embodiment which does not include the use of a compression spring, and although the spring switch element still has its characteristic force travel curve, the only source of effort to the spring switch element is that from the expansible material being transmitted through the rigid member 90. That is, the means of storing kinetic energy, i.e. the spring has been removed and thus the amount of expansion and contraction required for the switch-on and switch-off has been decreased and is directly related to reset differential. As a result, the switch in FIGS. 5 and 6 does not snap to close and is easily capable of resetting with a temperature differential less than 5° F. so that the fan could then be switched on at 225° F. or only 5° F. above the thermostat's wide open setting and then switch off at 220° F. to prevent overlap with the thermostat and with even less delay in restarting the fan when required. Furthermore, there is the convex surface 92 of the rigid member 90 which permits the diaphragm 38 to wrap thereabout as shown in FIG. 6 to absorb continued expansion of the thermally expansible material 46 during temperature excursions beyond the switch-on or calibration temperature when the switch spring element is against the stationary contact element and the rigid member is thereby stopped from moving further.

And it will be understood by those skilled in the art that while both embodiments have been disclosed as switching on or closed with temperature increase and resetting to off or open upon temperature decrease, the stationary contact in both cases may be rearranged relative to the switch spring element such that the reverse operation is obtained, i.e. switching on or closed upon temperature decrease and resetting to off or open upon temperature increase for use in other applications. Furthermore, it will be understood that all the above embodiments are illustrative of the invention which may be modified within the scope of the appended claims.

The embodiments of the invention in which an exclusive property or privilege is claimed are defined as follows:

1. In a thermal electric switch having a power element with a thermally expansible material acting on an elastomeric diaphragm to operate a switch mechanism which may operate with or without snap action: an improved switch operating arrangement comprising in combination, electrical contact means, electrical grounding means, an electrically conductible switch spring element inherently held out of contact with said contact means in an open switch condition and being flexible to contact therewith to connect same to said grounding means in a closed switch condition, and force transmitting means for transmitting force from the diaphragm to hold said switch spring element against said grounding means and also flex the switch spring element from one to the other of its switch conditions upon the thermally expansible material expanding while reaching a predetermined temperature and then permit the switch spring element to reset itself in said one switch condition upon the temperature dropping below the predetermined temperature, said force transmitting means including a convex surface that engages with and permits the diaphragm to stretch thereabout to allow for substantial expansion of the thermally expansible material on temperature excursions past the predetermined temperature.

2. In a thermal electric switch having a power element with a thermally expansible material acting on a normally flat elastomeric diaphragm of uniform thickness to operate a switch mechanism which may operate with or without snap action: an improved switch operating arrangement comprising in combination, electrical contact means, electrical grounding means including an annular grounding element, a disk-shaped electrically conductible switch spring element inherently held out of contact with said contact means in an open switch condition and being flexible to contact therewith through the open center of said grounding element to connect same to said grounding element in a closed switch condition, and force transmitting means for transmitting force from the diaphragm to hold said switch spring element adjacent the periphery thereof against said grounding element and also flex the switch spring element from one to the other of its switch conditions upon the thermally expansible material expanding while reaching a predetermined temperature and then permit the switch spring element to reset itself in said one switch condition upon the temperature dropping below the predetermined temperature, said force transmitting means including a convex surface that engages with and permits the diaphragm to stretch thereabout to allow for substantial expansion of the thermally expansible material on temperature excursions past the predetermined temperature.

3. In a thermal electric switch having a power element with a thermally expansible material acting on an elastomeric diaphragm to operate a switch mechanism which may operate with or without snap action: an improved switch operating arrangement comprising in combination, electrical contact means, electrical grounding means, an electrically conductible switch spring element inherently held out of contact with said contact means in an open switch condition and being flexible to contact therewith to connect same to said grounding means in a closed switch condition, and force transmitting means for transmitting force from the diaphragm to hold said switch spring element against said grounding means and also flex the switch spring element from one to the other of its switch conditions upon the thermally expansible material expanding while reaching a predetermined temperature and then permit the switch spring element to reset itself in said one switch condition upon the temperature dropping below the predetermined temperature, said force transmitting means comprising a compression spring and a rigid member which are arranged in series, said rigid member having a convex surface that engages with and permits the diaphragm to stretch thereabout whereby the compression spring and convex surface cooperatively allow for substantial expansion of the thermally expansible material on temperature excursions past the predetermined temperature.

4. In a thermal electric switch having a power element with a thermally expansible material acting on an elastomeric diaphragm to operate a switch mechanism which may operate with or without snap action: an improved switch operating arrangement comprising in combination, electrical contact means, electrical grounding means, an electrically conductible switch spring element inherently held out of contact with said contact means in an open switch condition and being flexible to contact therewith to connect same to said grounding means in a closed switch condition, and force transmitting means for transmitting force from the diaphragm to hold said switch spring element against said grounding means and also flex the switch spring element from one to the other of its switch condition upon the thermally expansible material expanding while reaching a predetermined temperature and then permit the switch spring element to reset itself in said one switch condition upon the temperature dropping below the predetermined temperature, said force transmitting means comprising a rigid member having a convex surface that engages with and permits the diaphragm to stretch thereabout to allow for substantial expansion of the thermally expansible material on temperature excursions past the predetermined temperature.

5. A thermo-responsive electric switch including a power element containing a thermally expansible material which acts on an elastomeric diaphragm to effect movement of a movable contact to or from a fixed contact to close or open the switch, in response to changes in temperature from a predetermined value, said diaphragm being normally flat and of uniform thickness, said movable contact being a spring member inherently biased towards engagement with a force transmitting device so as to effect movement of said movable contact from one to the other of its switch positions upon the expansion of said expansible material at said predetermined temperature value and to permit the movable contact to reset in said one position when the temperature falls below said predetermined value, said force transmitting device having a convex surface which is slidably closely fitted in a bore and which is in engagement with said diaphragm and which is such as to permit the diaphragm to stretch thereabout within the confine of the bore while said convex surface remains stationary to allow for substantial expansion of said thermally expansible material into the bore in the event of temperature excursions substantially above said predetermined value.

* * * * *